US006395402B1

(12) United States Patent
Lambert et al.

(10) Patent No.: US 6,395,402 B1
(45) Date of Patent: May 28, 2002

(54) ELECTRICALLY CONDUCTIVE POLYMERIC FOAM AND METHOD OF PREPARATION THEREOF

(75) Inventors: Michael Lambert, Randolph, NJ (US); Satish Chandra, Scranton; Tony Sosnowski, Stroudsburg, both of PA (US)

(73) Assignee: Laird Technologies, Inc., Delaware Water Gap, PA (US)

( * ) Notice: Subject to any disclaimer, the term of this patent is extended or adjusted under 35 U.S.C. 154(b) by 0 days.

(21) Appl. No.: 09/590,018

(22) Filed: Jun. 9, 2000

Related U.S. Application Data

(60) Provisional application No. 60/138,279, filed on Jun. 9, 1999.

(51) Int. Cl.[7] ..... B22F 3/10; C23C 3/02; B32B 5/18

(52) U.S. Cl. ..... 428/550; 427/304; 427/305; 427/306; 427/404; 427/443.1; 106/1.25; 106/1.26; 106/1.28; 428/613; 428/672; 428/675; 428/680; 428/929; 428/936

(58) Field of Search ..... 427/304, 305, 427/306, 404, 443.1; 106/1.25, 1.26, 1.28; 428/550, 613, 672, 675, 680, 929, 936

(56) References Cited

U.S. PATENT DOCUMENTS

| | | | | |
|---|---|---|---|---|
| 3,661,597 | A | 5/1972 | Gulla | 106/1 |
| 3,728,137 | A | 4/1973 | Shipley et al. | 106/1 |
| 3,765,936 | A | 10/1973 | Shipley et al. | 117/212 |
| 3,877,965 | A | 4/1975 | Broadbent et al. | 427/304 |
| 4,061,802 | A | 12/1977 | Costello | 427/304 |
| 4,503,131 | A | 3/1985 | Baudrand | 428/672 |
| 4,520,046 | A | 5/1985 | McCaskie et al. | 427/304 |
| 4,592,929 | A | 6/1986 | Tubergen et al. | 427/98 |
| 5,120,578 | A | 6/1992 | Chen et al. | 427/304 |
| 5,151,222 | A | 9/1992 | Ruffoni | 252/511 |

*Primary Examiner*—Samuel A. Acquah
(74) *Attorney, Agent, or Firm*—Pitney, Hardin, Kipp & Szuch LLP

(57) ABSTRACT

Provided are methods of preparing an electrically conductive polymeric foam. The methods include the following steps: (a) contacting a polymeric foam with a surfactant solution; (b) contacting the polymeric foam with a sensitizing solution; (c) contacting the polymeric foam with an activation solution; and (d) forming at least one metallic layer on the polymeric foam with an electroless plating process. Also provided are electrically conductive polymeric foams formed by such methods. The present methods and foams have particular applicability to the manufacture of EMI (electromagnetic interference) shielding devices.

39 Claims, No Drawings

ELECTRICALLY CONDUCTIVE POLYMERIC FOAM AND METHOD OF PREPARATION THEREOF

CROSS-REFERENCE TO RELATED APPLICATIONS

This application claims under 35 U.S.C. §119(e) the benefit of provisional application Ser. No. 60/138,279, filed Jun. 9, 1999, the entire contents of which application are incorporated herein by reference.

BACKGROUND OF THE INVENTION

1. Field of the Invention

The present invention relates to a method of preparing an electrically conductive polymeric foam. The invention also relates to an electrically conductive polymeric foam which can be formed by such method. The invention has particular applicability to the manufacture of EMI (electromagnetic interference) shielding and grounding devices and filters.

2. Description of the Related Art

EMI shielding devices are employed in the electronics industry with application in, for example, telecommunication and computer related technologies.

There are a number of EMI gaskets commercially available in which a metallized yarn is knitted over a soft foam core or a metallized fabric is wrapped around a soft foam core. Such gaskets include, for example, Instrument Specialties Soft Knit, UltraSoft Knit and ElectroFab, Chomerics Soft-Shield and Schlegels fabric-over-foam product. Another type of gasket is available from Seiren Co., Ltd., which offers an open cell polyurethane foam that is attached to a thick, woven backing layer. This composite is then metallized, starting with a deposited aluminum (Al) layer. There are, however, various potential problems associated with such conductive foam materials. For example, these multistructured materials are typically somewhat complicated in structure, which can lead to high manufacturing costs as well as to inconsistencies in the product formed. For some of these products, adhesion of the metallic coating to the polymer substrate has been a problem. For example, flaking and loss of the coating typically occurs which can ultimately reduce the conductivity and shielding effectiveness of the foam.

Another known conductive foam structure is described in U.S. Pat. No. 5,151,222, to Ruffoni, the entire contents of which document are incorporated herein by reference. That document discloses a foam absorber having electromagnetic energy attenuation characteristics comprising an open cell reticulated polyurethane foam impregnated with a conductive ink applied by spraying to a surface of the foam. In such spray coating processes, it can be difficult to obtain a uniform coating on the foam surface.

An additional known process for forming conductive foam involves impregnation of a foam with a conductive material. Such structures typically suffer from poor mechanical properties, such as compressive force and compressive set.

To overcome or conspicuously ameliorate the problems associated with the related art, the present inventors have provided a method of preparing a low compression force foam and a low compression force foam prepared thereby. The foam is made conductive by metallizing the surface thereof, preferably the entire surface thereof. Such conductive foam provides significant advantages when employed in a component such as a gasket. For example, the conductive foam in accordance with the invention is of a simpler and more consistent design than known materials. The conductive foam preferably has a one-piece design. As a result of the simple design, the conductive foam components such as gaskets are considerably easier to manufacture than conventional foam-based components. The simple design typically makes just-in-time delivery easier to achieve since there are fewer manufacturing steps involved. In addition, the cost for manufacturing the conductive foam in accordance with the invention typically is less than that for the knitted and fabric covered gaskets. The plating technology used in the present invention can also enhance the adhesion of the plating to the polymer substrate. This improved coating adhesion can greatly reduce flaking of the coating(s) and help maintain good EMI performance during use.

Other objects and aspects of the present invention will become apparent to one of ordinary skill in the art upon review of the specification and claims appended hereto.

SUMMARY OF THE INVENTION

The foregoing objectives are met by the methods and polymeric foams of the present invention. According to a first aspect of the present invention, a method is provided of preparing an electrically conductive polymeric foam. The method comprises the steps of:

(a) contacting a polymeric foam with a surfactant solution;

(b) contacting the polymeric foam with a sensitizing solution;

(c) contacting the polymeric foam with an activation solution; and (d) forming at least one metallic layer on the polymeric foam with an electroless plating process.

According to another aspect of the present invention, a method is provided of preparing an electrically conductive polymeric foam. The method comprises the steps of:

(a) contacting a polymeric foam with a surfactant solution, wherein the surfactant solution comprises a material selected from the group consisting of an anionic surfactant, a cationic surfactant, a non-ionic surfactant and combinations thereof;

(b) contacting the polymeric foam with a sensitizing solution, wherein the sensitizing solution comprises a salt, a solvent and water;

(c) contacting the polymeric foam with an activation solution, wherein the activation solution comprises a metal compound, a solvent and water; and (d) forming at least one metallic layer on the polymeric foam with an electroless plating process, wherein the at least one metallic layer comprises a metal selected from the group consisting of palladium, platinum, silver, copper, nickel, tin and combinations thereof.

According to a further aspect of the present invention, a method is provided of preparing an electrically conductive polymeric foam. The method comprises the steps of:

(a) contacting a polymeric foam with a surfactant solution;

(b) contacting the polymeric foam with a sensitizing and activation solution; and (c) forming at least one metallic layer on the polymeric foam with an electroless plating process.

According to further aspects of the present invention, electrically conductive polymeric foams formed by the above methods are provided.

DETAILED DESCRIPTION OF THE PREFERRED EMBODIMENTS OF THE INVENTION

In accordance with a first aspect of the invention, a method of forming an electrically conductive, low compression force polymeric foam is provided. Such a foam has numerous EMI shielding applications including, but not limited to, gasketing, die cut sections, vent panels, air filtration panels and laminates. The invention allows for both the electrical conductivity necessary for EMI shielding as well as very low closure forces in a single component product. The methods of the present invention can also be used in non-EMI applications such as, for example, water and chemical filters, and medical applications.

The conductive foams produced by the methods of the present invention typically provide a high degree of shielding effectiveness. For example, the foam exhibited a shielding effectiveness of greater than 70 decibels (dB), from 100 kHz to 100 MHz. The shielding effectiveness of the foam, which demonstrates the attenuation of a signal transmitted therethrough, was measured in accordance with the SAE-ARP-1705 transfer impedance test. In addition, the foam typically demonstrates a pressure probe resistance of less than 25 milliohms per square inch.

The polymeric foam can be any one or combination of a large variety of foams which are commercially available. For example, the polymeric foam can be a thermoplastic elastomer (TPE) such as Santoprene®, Neoprene® or a polyurethane-containing material such as polyester polyurethane, or combinations thereof. Of these, polyurethane-containing materials are particularly preferred.

The cell structure of the polymeric foam employed in the invention can be fully open, partially open or fully closed. Various techniques can be used to provide an open or partially open cell structure. For example, the foam can be quenched, i.e., contacted with a caustic solution. Additionally or alternatively, the foam can be treated with a flame, i.e., subjected to a zapping process. Preferably, the polymeric foam which is used as the starting material in the present methods is a quenched foam.

The invention advantageously allows for any foam pore size to be used. A pore size of from about 5 to 80 pores per inch (ppi) is typical. However, depending on the end use of the products formed, the pore size requirements may differ. For example, for ventilation/air filtration product applications, the pore size of the polymeric foam is preferably from about 5 to 25 ppi, more preferably from about 10 to 20 ppi. A preferred pore size of the polymeric foam for EMI gasket applications is, for example, from about 30 to 65 ppi, more preferably from about 45 to 60 ppi.

The dimensions of the polymeric foam can be varied depending on the particular application. While not being limited thereto, the thickness of the foam is typically from about 1/32 to 2 inches, the width of the foam is typically from about 1/32 to 48 inches, and the length of the foam is typically from about 1/4 inch to 1000 feet.

The polymeric foam can be arranged into various shapes depending on the particular application. The foam can be shaped using known techniques including, for example, extrusion, molding and cutting. In addition, the polymeric foam can be attached to a substrate to support, stiffen and/or shape the foam. The substrate can be attached to a surface using known methods, thereby facilitating the mounting and/or installation of the polymeric foam. The substrate can be made of a conductive or non-conductive material, depending upon the particular application. Typically, a plastic or metallic material is used. The substrate can be, for example, a clip-on track, a pressure sensitive adhesive (PSA) or a plurality of rivets. Other substrates known in the art can also be used.

The polymeric foam can be made of a flame retardant material. Additionally or alternatively, the foam can be treated to increase the flame retardant characteristics thereof using various techniques including, for example, treating the foam with a flame retardant material. Such flame retardant materials include, for example, halogen compounds, hydroxides, graphite and combinations thereof. Typical halogen compounds include, for example, chlorinated and brominated halogen compounds. Exemplary metal hydroxides include aluminum hydroxide and magnesium hydroxide. The foam can be treated before and/or after subjecting the foam to the electroless plating process.

To make the polymeric foam electrically conductive, one or more metallic layers are applied over the surface thereof, preferably the entire surface thereof. However, because polymeric materials are not electrically conductive, they cannot be plated by traditional electrolytic or electroless processes. To apply a plated metallic layer to the polymeric foam which adheres thereto without peeling, the foam surface should be subjected to a special pretreatment process followed by electroless plating.

The pretreatment process creates a surface on the polymeric foam which will accept and increase retention of the electroless plating. According to one aspect of the present invention, a pretreatment process includes the following steps: contacting a polymeric foam with a surfactant solution; contacting the polymeric foam with a sensitizing solution; and contacting the polymeric foam with an activation solution.

In the pretreatment process, the polymeric foam is subjected to a conditioning process which includes contacting the polymeric foam with a surfactant solution. The conditioning process typically reduces the amount of contaminants present within the foam such as, for example, dirt and debris. Also, the conditioning process typically imparts an electric charge to the foam, preferably a negative charge, which facilitates the receipt of a metal, such as tin, on the surface of the foam. The surfactant solution preferably includes an anionic, a cationic or a nonionic surfactant, or combinations thereof. Surfactants which can be used include, for example, tetra-sodium pyrophosphate; octoxynol-9, available from Union Carbide under the tradename Triton X-100®; and Merpol OJ® and Merpol HCS®, each available from Dupont. Combinations of these surfactants can also be used. The surfactant is typically present in the solution at a concentration of from about 0.1 to 8 vol % based on the solution, with the balance being water. The water used in this process as well as in the other steps of the pretreatment process can be deionized, distilled or tap water. The surfactant solution is typically maintained at a temperature of from about 20 to 100° C. The polymeric foam is typically contacted with the surfactant solution for an amount of time effective to condition the foam, preferably for about 3 to 35 minutes.

Following the conditioning process, the polymeric foam can optionally be rinsed to remove residual surfactant solution therefrom. The rinse step is typically from about 1 to 20 minutes in duration, and the temperature of the rinsing solution is typically from about 10 to 50° C. The rinsing solution preferably includes water. Deionized, distilled and/or tap water can be used.

The polymeric foam can then optionally be subjected to a surface treatment process to facilitate an even deposition of the later-applied metal on the surface of the foam, typically by roughening the surface of the foam. The surface treatment process typically includes contacting the polymeric foam with an acid solution. The acid solution can include, for example, hydrochloric acid (HCl), sulfuric acid ($H_2SO_4$), chromic acid ($CrO_3$) or combinations thereof, preferably at a concentration of from about 2 to 35 vol %, based on the weight of the acid solution. The temperature of the acid solution is preferably from about 10 to 60° C. and the process time is preferably from about 2 to 60 minutes.

Alternatively, the surface treatment process can include contacting the polymeric foam with an alkaline solution, for example, sodium hydroxide (NaOH), potassium hydroxide (KOH) or combinations thereof, having a concentration of from about 0.25 to 40 vol %. The temperature of such alkaline solution is preferably from about 10 to 100° C., and the process time is preferably from about 1 to 60 minutes.

In a preferred embodiment of the present invention, and as discussed above, quenched polymeric foam can be used as the starting material. Quenched polymeric foam is typically prepared by contacting a polymeric foam with a caustic solution including, for example, one of the exemplary alkaline solutions of the surface treatment process, such as sodium hydroxide. The caustic solution roughens the surface of the foam to a degree effective to facilitate the deposition of the later-applied metal on the foam. Alternatively, the quenched polymeric foam can be prepared by contacting the foam with an acid solution, such as one of the exemplary acid solutions of the surface treatment process. The quenched foam is typically not subjected to the optional surface treatment process. However, quenched foam can be subjected to the surface treatment process to further prepare the surface of the foam for deposition of the later-applied metal.

Following the surface treatment process, the foam is preferably rinsed in the manner described above.

The polymeric foam can optionally be subjected to a surface post treatment process. The surface post treatment process typically reduces the amount of contaminants which are present in the foam. In addition, the surface post treatment process typically at least partially neutralizes the amount of acidic or alkaline solution remaining from the conditioning process. For example, this step can include contacting the foam with a neutralizing solution, typically comprising HCl, $H_2SO_4$, NaOH, KOH or combinations thereof. In a preferred embodiment, the neutralizing solution includes an acid solution when the surface treatment process includes using an alkaline solution, or an alkaline solution when the surface treatment process includes using an acid solution. The concentration of the neutralizing solution is preferably from about 2 to 28 vol %. The neutralizing solution preferably is evenly deposited upon the polymeric foam. The temperature of the neutralizing solution is typically from about 10 to 60° C., and the process time is typically from about 1 to 30 minutes. Following the surface post treatment process, the foam can be rinsed in the manner described above.

The polymeric foam is subjected to a sensitizing process which includes contacting the foam with a sensitizing solution. The sensitizing process typically prepares the foam for contact with an activation solution. For example, the sensitizing solution can provide a material which bonds with the foam and facilitates the subsequent activation of the foam. The sensitizing solution preferably comprises salt, a solvent and water. The salt typically provides the material which bonds with the foam, and preferably includes stannous chloride ($SnCl_2$), stannic chloride ($SnCl_4$) or combinations thereof. The solvent preferably includes an alcohol such as ethanol, an acid such as hydrochloric acid, or combinations thereof. The concentration of the salt is typically from about 8 to 250 g/l, based on the total volume of the sensitizing solution. The solvent is typically present in an amount from about 2 to 30 vol % of the total volume of the sensitizing solution. The balance, e.g., from about 70 to 98 vol % of the total volume of the sensitizing solution, preferably is water. The temperature of the sensitizing solution is typically from about 10 to 45° C., and the process time is typically from about 3 to 45 minutes. Following the sensitizing treatment, the foam can optionally be rinsed in the manner described above.

The polymeric foam is subjected to an activation step which includes contacting the polymeric foam with an activation solution. As a result of this step, catalytic sites for the later-applied metal are established on the surface of the foam. The activation solution preferably comprises a metal compound, a solvent and water, wherein the metal compound is dissolved in the solvent. The metal compound can include any metal including, for example, gold (Au), silver (Ag), palladium (Pd), platinum (Pt) or combinations thereof. Typical metal compounds which can be used include, for example, gold chloride ($AuCl_2$), silver nitrate ($AgNO_3$), palladium chloride ($PdCl_2$), platinum chloride ($PtCl_2$) or combinations thereof. The solvent can include an acid solution including, for example, acetic acid, hydrochloric acid, sulfuric acid or combinations thereof. The solution typically contains from about 5 to 70 vol % of the mixture of the metal compound and the solvent, and from about 30 to 95 vol % water. According to a preferred embodiment, the metal compound includes an acid-based $PdCl_2$ solution, such as Enplate 440® (g, available from Enthone-OMI, more preferably, 50 vol % Enplate 440®. The process time is typically from about 1 to 60 minutes, and the solution temperature is preferably from about 10 to 75° C. Following the activation step, the foam can optionally be rinsed in the manner described above.

Each of the liquid treatment agents which are used in the pretreatment process can be contacted with the polymeric foam in a variety of ways. Without being limited in any way, the liquid treatment agents can be sprayed onto the foam or, preferably, the foam can be immersed in the liquid treatment agents. A combination of spraying and immersion can optionally be employed. Preferably, the entire surface of the polymeric foam is contacted with each of the different liquid treatment agents used in the pretreatment process.

Following the pretreatment process, the polymeric foam is ready to be plated with at least one metallic layer to form a metallic coating. The at least one metallic layer is formed on the polymeric foam using electroless plating. The electroless plating process has been well described in the literature. See, e.g., U.S. Pat. No. 3,661,597 to Gulla; U.S. Pat. No. 3,765,936 to Shipley et al; U.S. Pat. No. 4,061,802 to Costello; U.S. Pat. No. 4,503,131 to Baudrand; and U.S. Pat. No. 5,151,222 to Chen et al, the entire contents of which patents are incorporated herein by reference.

The metallic coating can include at least one metallic layer, preferably a plurality of metallic layers. Each layer can be formed of a variety of metals including, but not limited to, palladium (Pd), platinum (Pt), silver (Ag), copper (Cu), nickel (Ni), tin (Sn) and combinations of these metals. The combinations of these metals include, for example, alloys of the metals. The metallic coating is formed over at least part of the surface of the foam, preferably the entire surface of the foam. According to a preferred embodiment of the present invention, the metallic coating includes a first layer formed on the polymeric foam and a second layer formed on the first layer. The first layer is preferably formed of copper or an alloy thereof and the second layer is preferably formed of nickel or an alloy thereof.

The thickness of the metallic coating is defined in terms of plating weight which is the percent weight increase of the weight of the object being plated, i.e., the weight of the pretreated polymeric foam. Typically, the plating weight is from about 0.5% to 45%.

Plating can be performed using commercially available plating baths for any of the above mentioned metals. Suppliers of such plating baths including, for example, Atotech, MacDermid and Enthone-OMI, typically provide standard process conditions for using the plating baths, such as temperature, concentration and plating time. Through the invention, the inventors have unexpectedly found that advantageous results can be obtained by diluting commercial plating solutions beyond the manufacturer's specification to, for example, one half dilution, and/or employing a temperature that is lower than that recommended for the solution. These unexpected advantages can be realized in lower material costs as well as lower costs for power consumption.

Following the electroless plating process, the surface of the plated foam can optionally be treated with a passivation agent to improve the corrosion resistance of the metallic coating and/or to make the various materials used in the plating process more compatible with each other. For example, the passivation agent can chemically modify the surface of the plated foam to increase the corrosion resistance thereof. Metallic layers formed of copper and/or silver can preferably be treated with a benzotriazole compound, such as METEX 667, available from MacDermid. Metallic layers formed of aluminum, zinc and/or steel can preferably be treated with a chromate solution. Combinations of these solutions can also be used. Additionally or alternatively, the passivation agent can include a material which forms a barrier layer on the plated foam. For example, a polymer, a noble metal (e.g., gold, palladium and platinum) and combinations thereof can be used to form a thin barrier layer on the surface of the plated foam.

It is noted that any of the above-described pretreatment and plating processes can be performed as a batch process, a continuous process or a combination of a batch and continuous process. In addition, the pretreatment process may include fewer or additional steps to those outlined above. For example, the surface treatment and surface post treatment processes are preferably used but can be eliminated in certain cases, such as when a quenched polymeric foam is used as the starting material.

Any combination of the pretreatment steps can be performed simultaneously. For example, the sensitizing and activation steps can be combined as a single step, rather than performing them separately. In this embodiment, a single sensitizing and activation solution can be used. For example, the foam can be contacted with a tin palladium chloride solution, such as MACUPLEX D34, available from MacDermid. According to a preferred embodiment of the present invention, the sensitizing and activation solution includes from about 1.6 to 25 vol % MACUPLEX D34 and about 22 vol % hydrochloric acid, the balance being water. The temperature of the sensitizing and activation solution is typically from about 20 to 65° C., and the process time is typically from about 10 to 35 minutes. Following this treatment, the foam can optionally be rinsed in the manner described above.

The pretreatment steps can be performed in any sequence, preferably in the sequence as presented above. In this regard, foam manufacturers can provide foam that is partially pretreated, i.e., foam that has undergone at least one but not all of the above-described steps. Thus, the sequence of the process steps can be arranged such that any steps which are performed by a foam manufacturer are performed first. For example, the surface treatment process can be performed before the conditioning process.

The foam can be subjected to multiple activation and plating steps, more preferably, two activation and two plating steps. The foam is preferably subjected to an the activation step and plating step followed by another activation step and another plating step. Typically, the multiple activation and plating steps are used to coat the foam with multiple types of metals, for example, copper and nickel.

In order to further illustrate the present invention and the advantages thereof, the following examples are given which are intended to be illustrative and in no way limiting.

EXAMPLES

Example 1

A conductive foam is formed by: conditioning a polyester-polyurethane foam having a pore size of 65 ppi with a 3 vol % solution of tetra-sodium pyrophosphate at 70° C. for 15 minutes; surface treating with a 0.5 vol % NaOH solution at 90° C. for 2 minutes; surface post treating with 5 vol % HCl for 5 minutes at 28° C.; sensitizing with 80 g/l of stannous chloride and a 14 vol % HCl solution for 10 minutes at 25° C.; activating with a 50 vol % Enplate 440® solution for 10 minutes at 50° C.; and electroless plating of nickel with MacDermid J60 and J61 plating solutions for 5 minutes at 40° C., at 3 g/l, which is half of the recommended concentration. The foam is rinsed with water between steps.

Example 2

A conductive foam is formed by: conditioning a polyester-polyurethane foam with a 7 vol % solution of tetra-sodium pyrophosphate at 30° C. for 20 minutes; surface treating with an 18 vol % NaOH solution at 35° C. for 30 minutes; sensitizing with 22 g/l of stannous chloride, and a 9 vol % HCl solution for 50 minutes at 25° C.; activating with 20 vol % Enplate 440® solution for 60 minutes at 15° C.; and electroless plating of copper with Atotech LC plating solution for 5 minutes at 27° C. The foam is rinsed with water between steps.

Example 3

A conductive foam is formed by: conditioning a polyester-polyurethane foam having a pore size of 60 ppi with a 3 vol % solution of tetra-sodium pyrophosphate at 70° C. for 12 minutes; surface treating with a 0.5 vol % NaOH solution at 90° C. for 2 minutes; surface post treating with 5 vol % HCl for 5 minutes at 28° C.; sensitizing with 80 g/l of stannous chloride, and a 14 vol % HCl solution for 10 minutes at 25° C.; activating with the activation solution as described in Example 1 for 10 minutes at 50° C., and electroless plating of nickel with MacDermid J60 and J61 plating solutions for 5 minutes at 40° C., at 3 g/l. The foam is rinsed with water between steps.

Example 4

A conductive foam is formed by: conditioning a polyester-polyurethane foam having a pore size of 10 ppi with a 6 vol % solution of Merpol OJ® (Dupont) at 38° C. for 10 minutes; surface treating with a 30 vol % KOH solution at 45° C. for 60 minutes; post-surface treating in 10 vol % $H_2SO_4$ at 40° C. for 15 minutes; sensitizing with 120 g/1 of stannous chloride, and a 5 vol % HCl solution for 25 minutes at 25° C.; activating with 10 vol % Enplate 440® solution for 55 minutes at 30° C.; and electroless plating of copper with Atotech LC plating solution for 6 minutes at 25° C. The foam is rinsed with water between steps.

Example 5

A conductive foam is formed by: conditioning a polyester-polyurethane foam with a 0.5 vol % solution of Triton X-100® at 65° C. for 10 minutes; surface treating with a 0.5 vol % NaOH solution at 90° C. for 2 minutes; surface treating with a 5 vol % HCl solution at 25° C. for 5 minutes; sensitizing with 70 g/1 of stannous chloride, and a 12 vol % HCl solution for 10 minutes at 25° C.; activating with the activation solution as described in Example 1 for 10 minutes at 50° C., and electroless plating of nickel with MacDermid J60 and J61 plating solutions for 6 minutes at 40° C., at 3 g/l.

Example 6

A conductive foam is formed by: conditioning a polyester-polyurethane foam with a pore size of 10 ppi with a 7 vol % solution of Merpol HCS® (Dupont) for 10 minutes at 35° C.; surface treating with a 20 vol % $H_2SO_4$ solution at 45° C. for 15 minutes; post-surface treating in 10 vol % NaOH solution at 30° C. for 5 minutes; sensitizing with 18 g/l of stannous chloride, and a 4 vol % HCl solution for 35 minutes at 25 ° C.; activating with 25 vol % Enplate 440® solution for 45 minutes at 35° C.; and electroless plating of copper with Atotech LC plating solution for 5 minutes at 20° C. The foam is rinsed with water between steps.

Example 7

A conductive foam is formed by: conditioning a polyester-polyurethane foam having a pore size of 30 ppi with a 1 vol % solution of Triton X-100® at 75° C. for 10 minutes; surface treating with a 2 vol % NaOH solution at 95° C. for 2 minutes; surface post treating with 5 vol % HCl for 5 minutes at 32° C.; sensitizing with 100 g/l of stannous chloride and a 13 vol % HCl solution at 30° C. for 20 minutes; activating with a 55 vol % activation solution for 20 minutes at 51° C., wherein the activation solution is prepared as in Example 1; electroless plating of nickel with MacDermid J60 and J61 plating solutions for 3 minutes at 40° C., at 3 g/l; electroless plating of copper with Atotech LC plating solution for 1 minute at 20° C.; activating with a 6.7 vol % activation solution for 1 minute at 30° C, wherein the activation solution is prepared as in Example 1; and electroless plating of nickel with MacDermid J60 and J61 plating solutions for 3 minutes at 40° C., at 3 g/l. The foam is rinsed with water between steps.

Example 8

A conductive foam is formed by: conditioning a polyester-polyurethane quenched foam with a 1 vol % solution of Triton X-100® at 75° C. for 15 minutes; sensitizing with 10 g/l of stannous chloride and a 10 vol % HCl solution at 30° C. for 20 minutes; activating with a 25 vol % Enplate 440® solution at 55° C. for 20 minutes; electroless plating of copper with Atotech LC plating solution for 3 minutes at 25 ° C.; activating with a 10 vol % Enplate 440® solution at 32° C. for 1 minute; and electroless plating of nickel with MacDermid J60 and J61 plating solutions at 35° C. for 3 minutes. The foam is rinsed with water between steps.

While the invention has been described in detail with reference to specific embodiments thereof, it will be apparent to one skilled in the art that various changes and modifications can be made, and equivalents employed without departing from the scope of the claims.

What is claimed is:

1. Method of preparing an electrically conductive polymeric foam, comprising the steps of:

(a) contacting a low compression force polymeric foam with a surfactant solution;

(b) contacting the polymeric foam with a sensitizing solution;

(c) contacting the polymeric foam with an activation solution; and (d) forming at least one metallic layer on the polymeric foam with an electroless plating process.

2. Method according to claim 1, wherein steps (a), (b), (c), and (d) are performed sequentially.

3. Method according to claim 1, wherein two or more of steps (a), (b), (c), and (d) are performed simultaneously.

4. Method according to claim 3, wherein steps (b) and (c) are performed simultaneously.

5. Method according to claim 1, wherein the surfactant solution comprises a material selected from the group consisting of an anionic surfactant, a cationic surfactant, a non-ionic surfactant and combinations thereof.

6. Method according to claim 1, further comprising a step (a') of contacting the polymeric foam with an acid or alkaline solution.

7. Method according to claim 6, wherein the acid or alkaline solution comprises an acid solution, and wherein the acid solution comprises an acid selected from the group consisting of hydrochloric acid, sulfuric acid, chromic acid and combinations thereof.

8. Method according to claim 6, wherein the acid or alkaline solution comprises an alkaline solution, and wherein the alkaline solution comprises a base selected from the group consisting of sodium hydroxide, potassium hydroxide and combinations thereof.

9. Method according to claim 6, further comprising a second step (a") of contacting the polymeric foam with an acid or alkaline solution, wherein the polymeric foam is contacted with an acid solution in step (a") when the polymeric foam is contacted with an alkaline solution in step (a'), and wherein the polymeric foam is contacted with an alkaline solution in step (a") when the polymeric foam is contacted with an acid solution in step (a').

10. Method according to claim 1, wherein the polymeric foam is contacted with a caustic solution prior to steps (a), (b), (c) and (d), thereby resulting in a quenched polymeric foam.

11. Method according to claim 10, wherein the caustic solution comprises an alkaline solution, and wherein the alkaline solution comprises a base selected from the group consisting of sodium hydroxide, potassium hydroxide and combinations thereof.

12. Method according to claim 10, further comprising a step (a') of contacting the polymeric foam with an acid or alkaline solution.

13. Method according to claim 1, wherein the sensitizing solution comprises a salt, a solvent and water.

14. Method according to claim 13, wherein the salt comprises a material selected from the group consisting of stannous chloride, stannic chloride and combinations thereof.

15. Method according to claim 13, wherein the solvent comprises a material selected from the group consisting of an alcohol, an acid and combinations thereof.

16. Method according to claim 1, wherein the activation solution comprises a metal compound, a solvent and water.

17. Method according to claim 16, wherein the metal compound comprises a metal selected from the group consisting of gold, silver, palladium, platinum and combinations thereof.

18. Method according to claim 17, wherein the metal compound is selected from the group consisting of gold chloride, silver nitrate, palladium chloride, platinum chloride and combinations thereof.

19. Method according to claim 16, wherein the solvent comprises an acid selected from the group consisting of acetic acid, hydrochloric acid, sulfuric acid and combinations thereof.

20. Method according to claim 1, further comprising a step of rinsing the polymeric foam with water prior to at least one of steps (a), (b), (c) and (d).

21. Method according to claim 20, comprising a step of rinsing the polymeric foam with water prior to each of steps (a), (b), (c) and (d).

22. Method according to claim 1, wherein the polymeric foam comprises a polymeric material selected from the group consisting of a thermoplastic elastomer, rubber, a polyurethane-containing material and combinations thereof.

23. Method according to claim 1, wherein a plurality of metallic layers are formed on the polymeric foam.

24. Method according to claim 23, wherein the plurality of metallic layers comprises a first layer formed on the polymeric foam and a second layer formed on the first layer, and wherein the first layer is formed of copper and the second layer is formed of nickel.

25. Method according to claim 1, wherein the at least one metallic layer comprises a metal selected from the group consisting of palladium, platinum, silver, copper, nickel, tin and combinations thereof.

26. Method according to claim 25, wherein the combination of the metals comprises an alloy of at least two of the metals.

27. Method according to claim 1, wherein the at least one metallic layer comprises an alloy, and wherein the alloy comprises a metal selected from the group consisting of palladium, platinum, silver, copper, nickel, tin and combinations thereof.

28. Method according to claim 1, further comprising a second step (c') of contacting the polymeric foam with an activation solution and a second step (d') of forming at least one metallic layer upon the polymeric foam with an electroless plating process.

29. Method according to claim 1, wherein each solution is contacted with the polymeric foam by immersing the foam therein.

30. Method according to claim 1, wherein the pore size of the polymeric foam is from about 5 to 80 ppi.

31. Method according to claim 1, wherein the plating weight of the at least one metallic layer is from about 0.5% to 45% based on the total weight of the polymeric foam.

32. Method according to claim 1, further comprising a step (e) of contacting the plated polymeric foam with a passivation agent, wherein the passivation agent comprises a material selected from the group consisting of a benzotriazole compound solution, a chromate solution and combinations thereof.

33. Method according to claim 1, further comprising a step (e) of contacting the plated polymeric foam with a passivation agent, wherein the passivation agent forms a barrier layer on the plated polymeric foam, and wherein the barrier layer is formed of a material selected from the group consisting of a polymer, a noble metal and combinations thereof.

34. An electrically conductive polymeric foam formed by the method of claim 1.

35. Method of preparing an electrically conductive polymeric foam, comprising the steps of:

(a) contacting a low compression force polymeric foam with a surfactant solution, wherein the surfactant solution comprises a material selected from the group consisting of an anionic surfactant, a cationic surfactant, a non-ionic surfactant and combinations thereof;

(b) contacting the polymeric foam with a sensitizing solution, wherein the sensitizing solution comprises a salt, a solvent and water;

(c) contacting the polymeric foam with an activation solution, wherein the activation solution comprises a metal compound, a solvent and water; and (d) forming at least one material layer on the polymeric foam with an electroless plating process, wherein the at least one metallic layer comprises a metal selected from the group consisting of palladium, silver, copper, nickel, tin and combinations thereof.

36. An electrically conductive polymeric foam formed by the method of claim 35.

37. Method of preparing an electrically conductive polymeric foam, comprising the steps of:

(a) contacting a low compression force polymeric foam with a surfactant solution;

(b) contacting the polymeric foam with a sensitizing and activation solution; and (c) forming at least one metallic layer on the polymeric foam with an electroless plating process.

38. Method according to claim 37, wherein the sensitizing and activation solution comprises a tin palladium chloride solution, hydrochloric acid and water.

39. An electrically conductive polymeric foam formed by the method of claim 37.

* * * * *